United States Patent [19]

Nishida

[11] 4,117,817

[45] Oct. 3, 1978

[54] SYSTEM FOR DRAINING AIR FROM AN ENGINE FUEL FILTER

[75] Inventor: Tsuyeshi Nishida, Sakaishi, Japan

[73] Assignee: Kubota, Ltd., Osaka, Japan

[21] Appl. No.: 785,830

[22] Filed: Apr. 8, 1977

[30] Foreign Application Priority Data

Jan. 24, 1977 [JP] Japan ..... 52-7141

[51] Int. Cl.[2] ..... F02M 59/44; B65D 25/54

[52] U.S. Cl. ..... 123/136; 220/85 VR; 220/85 VS; 55/182

[58] Field of Search ..... 123/136; 220/85 VR, 220/85 VS; 55/182, 88

[56] References Cited

U.S. PATENT DOCUMENTS

| | | | |
|---|---|---|---|
| 1,414,356 | 5/1922 | Evans | 123/136 |
| 3,118,492 | 1/1964 | Stone | 123/136 |
| 3,777,927 | 12/1973 | Fricker | 220/85 VR |
| 3,948,626 | 4/1976 | Bragg | 55/182 |

FOREIGN PATENT DOCUMENTS

| | | | |
|---|---|---|---|
| 2,222,880 | 10/1974 | France | 55/182 |
| 15,885 of | 1906 | United Kingdom | 123/136 |

*Primary Examiner*—Charles J. Myhre
*Assistant Examiner*—P. S. Lall
*Attorney, Agent, or Firm*—Bacon & Thomas

[57] ABSTRACT

In an engine assembly a fuel reservoir is located at a relatively high position, a fuel pump at a relatively low position, and a fuel strainer between the two. The strainer is fitted with a three-way cock, which in turn is connected by an inclined conduit to the fuel reservoir. In one position, the cock is closed. In the other two positions, it connects with either the unfiltered-fuel chamber or the filtered-fuel chamber of the fuel strainer, to drain air from the connected chamber into the fuel reservoir. With the arrangement, fuel entrained in escaping air is captured, and now allowed to enter the atmosphere.

8 Claims, 8 Drawing Figures

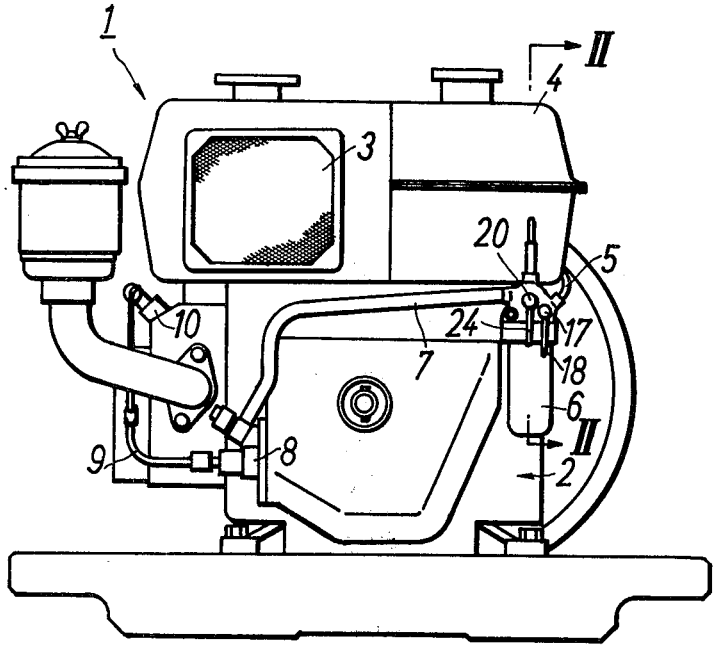
Fig.1
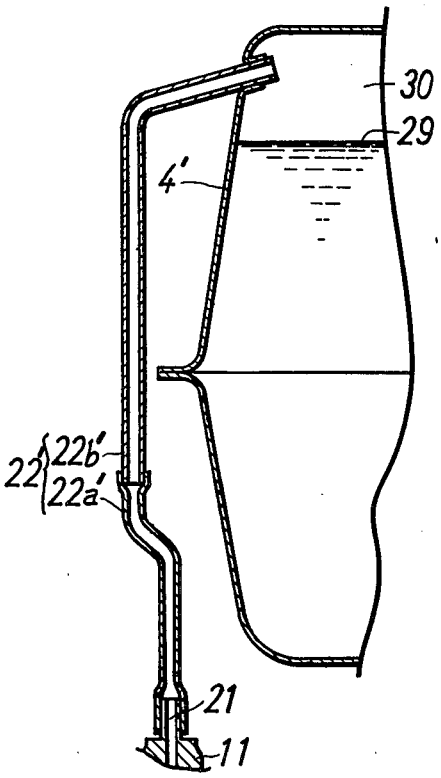
Fig.7
Fig.8
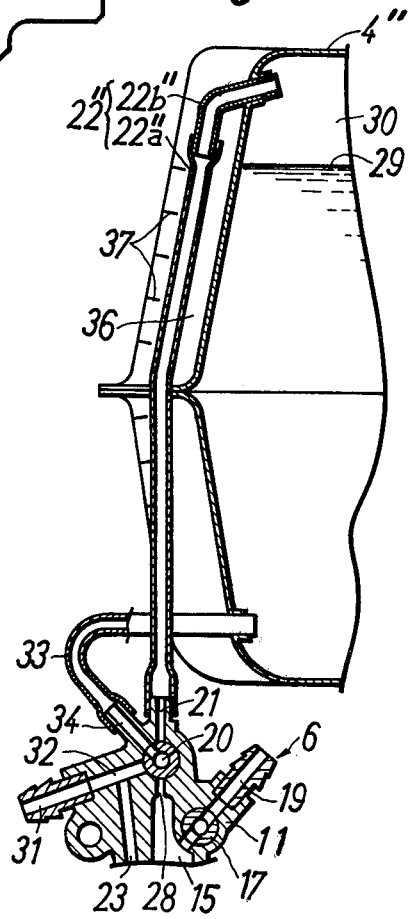

SYSTEM FOR DRAINING AIR FROM AN ENGINE FUEL FILTER

BACKGROUND OF THE INVENTION

1. Field of the Invention

The present invention relates generally to a system for incorporation with a fuel strainer of an engine, for draining air from the strainer and the fuel pipelines. More particularly, it relates to an air draining system for letting air out of the strainer and fuel paths of an engine, but which returns any fuel entrained in the escaping air to the engine fuel reservoir, with no leakage thereof to the outside.

2. Description of the Prior Art

It is a common practice to provide for the escape of entrapped air through a hole formed in the ceiling of a chamber in a fuel strainer through which fuel passes. The hole is normally covered or closed by a threaded plug, which is removed when it is desired to allow entrapped air to escape, and then replaced.

This conventional arrangement has several disadvantages. First of all, some air is likely to remain in the chamber, especially when the chamber of the fuel strainer is the one through which the unfiltered fuel flows. A special contrivance is then needed in the structure of this section of the strainer to deal with the remaining trapped air, which requires expensive engineering and adds cost to the fuel strainer.

A second disadvantage is simply that the threaded plug must be repeatedly unfastened and fastened, usually with the use of a special tool, such as a screwdriver. The operator normally does not welcome the need for repeatedly removing and replacing the plug, and these repeated operations can cause damage to the packings or seals, resulting in fuel leakage.

A further disadvantage of the conventional arrangement is that fuel tends to follow the flowing, escaping air, and rises up the fuel pipelines together with the air. When the air with its entrained fuel leaks outside the fuel strainer, it can stain the external surfaces of the strainer and the ground. Further, this is a waste of fuel, is dangerous in that it can explode or cause a fire, and air pollution can result.

The present invention is directed toward solving these problems, and has as its principal object to provide an improved air draining system, adapted for use with an engine fuel strainer, and designed to provide for draining of the air with no complicated procedures and with no resultant leakage of fuel.

SUMMARY OF THE INVENTION

The air draining system of the invention includes a fuel reservoir located at a relatively high position, a jet pump located at a relatively low position, and a fuel strainer located between the reservoir and the pump, the strainer having a fuel-supply cock and an air-drain cock, both located in the upper portion thereof. The fuel-supply cock receives a supply pipe connected to the bottom of the fuel reservior, and the air-drain cock has one end of an air-escape pipe connected thereto, the pipe extending to the fuel reservoir at an oblique, inclined angle. The strainer and the fuel pump are connected by a pipe inclined downstream, and the air-drain cock is made so that it can be switched to any of three positions. In its first position, corresponding to when air is to be drained from the unfiltered-fuel chamber of the strainer, said chamber is connected to the air-escape pipe, allowing the entrapped air and any entrained fuel to drain into the fuel reservoir. In its second position, the air-drain cock similarly connects the filtered-fuel chamber of the strainer to the fuel reservoir. When the air-drain cock is in its third position, no access is provided from either chamber of the strainer to the air-escape pipe.

In addition to the principal object noted above, it is also an object of the invention to provide an engine assembly having an air draining system that can be selectively utilized to drain air from either chamber of a fuel strainer.

Another object is to provide an air draining system that is simple to operate, and which can be easily closed down to ensure safe engine operation.

Other objects and many of the attendant advantages of the invention will be readily understood from the following detailed Description of the Preferred Embodiments, when taken in conjunction with the accompanying drawings.

BRIEF DESCRIPTION OF THE DRAWINGS

FIG. 1 is a front view of a horizontal diesel engine including an air draining system constructed according to the present invention;

FIG. 7 is a transverse sectional view through a modified version of the fuel reservoir; and FIG. 8 is a transverse sectional view through a further modified version of the fuel reservoir.

DESCRIPTION OF THE PREFERRED EMBODIMENTS

Figure 2:
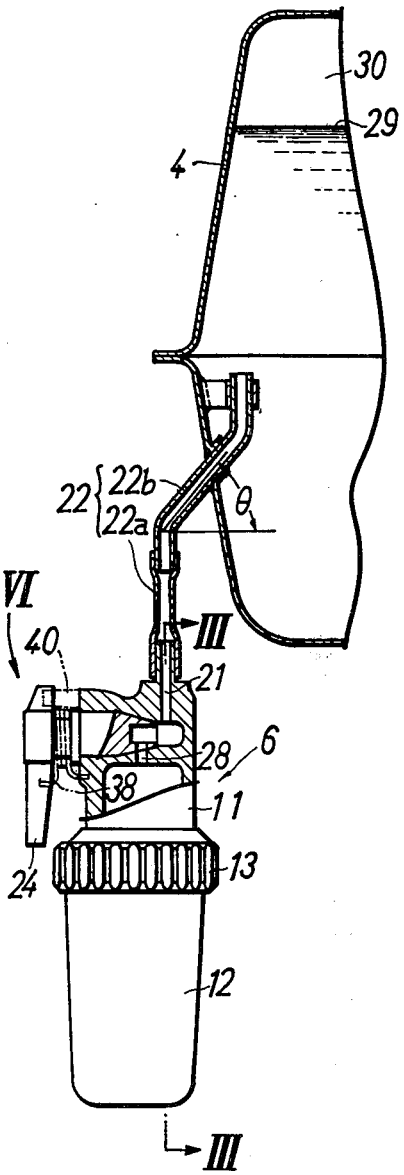
FIG. 2 is a fragmentary, transverse sectional view through the engine of FIG. 1, taken along the line II—II therein.

Referring now to FIG. 1, a horizontal diesel engine is shown at 1 having an engine body 2 on which a radiator 3 and a fuel reservoir 4 are provided. Under the fuel reservior there is mounted a fuel strainer 6, and a fuel pump 8 is located at a position below, and which is not to be higher than, the fuel strainer 6. The fuel in the reservoir 4 is led to the engine's combustion chamber (not shown) via a supply pipe 5, the strainer 6, a passage 7, the fuel pump 8, a high-pressure pipe 9 and a nozzle 10.

Figure 3:
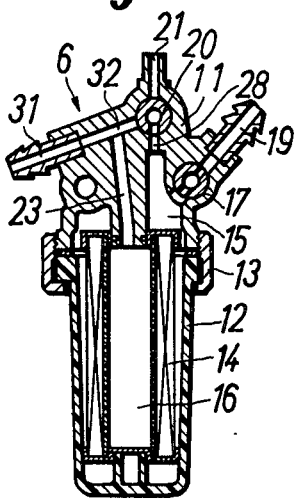
FIG. 3 is a transverse sectional view through the strainer of FIG. 2, taken along the line III—III therein.
Figure 4:
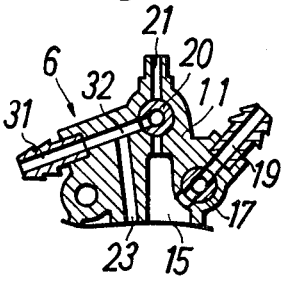
FIGS. 4 and 5 are sectional views showing the operation of the air-drain cock, when switched to different positions.

As is best illustrated in FIGS. 2 and 3, the strainer 6 includes a body 11 that can be cast of aluminum or the like, and a transparent filter bowl 12 of a suitable plastic or the like, which is hung from the body by a retaining nut 13. In the filter bowl 12 is mounted a cylinrical filter 14, which is held by the body 11 and the bowl itself. The strainer 6 includes two chambers 15 and 16 for containing an unfiltered fuel and a filtered fuel, respectively. The unfiltered-fuel chamber 15 is outside the filter 14, and the filtered-fuel chamber 16 is inside it. The body 11 is provided with a fuel cock 17 in its right-hand shoulder, mounted in such a manner that the cock is operated by a handle 18 to open and close a bore 19 leading to the chamber 15. The fuel supply pipeline 5 is connected between the bore 19 and the bottom of the fuel reservoir 4.

In the upper part of the body 11 there is provided an air-drain cock 20, which leads to an air-drain passage 21 connected to an air-escape line 22 consisting of two connected pipes 22*a* and 22*b*. The air-escape line 22 is connected to extend obliquely to the fuel reservoir 4. Preferably, the angle of inclination ($\theta$) will be at 15°, or more, from the horizontal. A bore 23 leading from the filtered-fuel chamber 16 is connected to a downwardly-sloped passage 31, which includes an air-drain bore 32 leading to the air-drain cock 20. The air-drain bore 32 proceeds upwardly from the downwardly-sloped passage 31. The fuel passage 7 connecting between the passage 31 and the pump 8 is declined downstream of the fuel flow.

Figure 6:
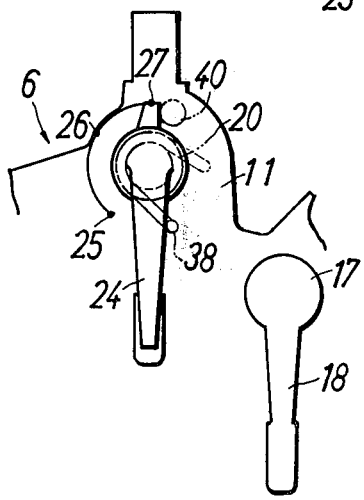
FIG. 6 is a fragmentary plan view on a larger scale, illustrating the portion indicated by the arrow VI in FIG. 2.

The air-drain cock 20 is so constructed as to be switchable to any one of three different positions by means of its handle 24, as is best illustrated in FIG. 6. A first position 25 will drain air from the unfiltered-fuel chamber 15; a second position 26 will drain air from the filtered-fuel chamber 16; and a third position 27 corresponds to the situation in which no air is being drained from either chamber. When the air-drain cock 20 is switched to the first position 25, it allows the air in the unfiltered-fuel chamber 15 to pass through an air-drain passage 28 together with the fuel rising therethrough, as is illustrated in FIG. 3. In this way the air and any entrained fuel is introduced into the reservoir 4 via the passage 28, the cock 20, the passage 21 and the air-escape line 22. The air and any entrained fuel smoothly enter the reservoir 4 by virtue of the inclined inlet pipe 22*b*, which, as mentioned above, is preferably angled at 15° or more to the horizontal.

When the air-drain cock 20 is switched to its second position 26, the air-drain bore 32 is opened, thereby allowing the air in the filtered-fuel chamber 16 to pass therethrough together with the fuel rising through the bore. In this way the air and any entrained fuel is introduced into the reservoir 4. In either case just mentioned, the air and fuel are introduced into the reservoir 4 from a point under the surface 29 of the liquid therein, as is best illustrated in FIG. 2.

Figure 5:
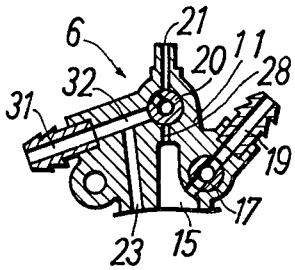

When the drain cock 20 is returned to its third position 27, the air-drain passages 28 and 32 are both closed, so that the air draining is stopped from both of the chambers 15 and 16, as is illustrated in FIG. 5.

The embodiment referred to above can be variously modified as follows:

(1) The air-drain cock 20 can be provided with a coiled spring 38, which is shown by a dotted line in FIGS. 2 and 6, so as to cause the cock to return to its third position 27 under the urging of the spring. A stop 40 brings the cock to a standstill at the right place. Thus, the air-drain cock can be automatically returned to its "closed" position 27 when the handle 24 comes out of touch with the operator's hand. This obviates the danger that the cock might remain in its second position 26, wherein the air in the filtered-fuel chamber 16 is drained. If the engine 1 is started with the cock 20 in its second position 26, the fuel in the reservoir 4 is likely to flow through the line 22, the cock 20, and the passage 32, and to be sucked into the passage 7 leading to the combustion chamber. This will cause a trouble in the pump 8, the nozzle 10, and the engine's combustion chamber.

(2) As is illustrated in FIG. 7, the air-escape line 22' can be extended upwards so as to enable its open end to reach above the liquid surface 29 in the reservoir 4'. Thus, the air-escape line then opens in the space 30 over the liquid surface 29. Preferably, the end portion of the pipe 22*b'* is inserted in the reservoir at an upwardly inclined angle. This arrangement will be of particular advantage when the engine has been carelessly started while the air-drain cock 20 remains in its second position 26, because in such a case the air in the space 30 would be sucked into the pump 8 via the line 22', the cock 20, the passage 32 and the passage 7, and immediately stop the engine. In this way the engine's combustion chamber is protected against a possible entering of an unfiltered fuel.

(3) As is illustrated in FIG. 8, it can be arranged so that the lower pipe 22*a''* of the air-drain line 22'' can function as a level gauge indicating the level in the reservoir 4. To do this, the pipe 22*a''* is made of a transparent material, and is located in a length-wise depression 36 vertically produced on the outside wall of the reservoir 4''. The pipe 22*b''* is inserted obliquely into the space 30, at an angle to the horizontal. When the air-drain cock 20 is returned to its third position 27, the cock is communicated with the bottom of the reservoir 4'' via the bore 34 and the passage 33, as well as the space 30 therein via the bore 21 and the line 22. Under this arrangement the fuel level 29 in the reservoir can be indicated in the pipe 22'', wherein it is preferred to provide a scale 37 along the line 22''. The interior of the reservoir is safe from the sucking force of the pump 8, because the bores 21 and 28 are shut against the reservoir, so that no turbulence occurs on the liquid surface.

As is evident from the foregoing, various advantages are obtained with the invention. For example, the following effects are particularly advantageous:

(1) The air can be readily drained from either of the unfiltered-fuel chamber 15 or the filtered-fuel chamber 16 by switching the air-drain cock 20 in three different ways, that is, to any one of the positions 25, 26 and 27, wherein the last-mentioned position 27 corresponds to the suspension of air-draining from any of the chambers;

(2) The air-drain cock 20 can be operated by hand, without the use of any special tool;

(3) When the air is drained from the strainer 6, it is followed by the fuel flow through the same pipes, but the following or entrained fuel is introduced into the reservoir together with the air. This eliminates the trouble that the external surfaces of the strainer, its parts and the ground are stained with the spilt fuel, and also prevents a fire hazard due to the spilt fuel, or unnecessary air pollution; and (4) When the strainer 6 of the pump 8 are disassembled, the fuel in the reservoir can be prevented from flowing therefrom into other parts merely by switching the air-drain cock 20 to the position 27. This facilitates the disassembling operation.

What is claimed is:

1. A system for draining air and entrained vapor contained within a fuel strainer and connected fuel paths of an engine, said system including:

an engine;

a fuel reservoir located on the engine at a relatively high position;

fuel pump means located on the engine at a relatively low position;

a fuel strainer located on the engine between said fuel reservoir and said fuel pump means, said strainer including a fuel cock and a drain cock in the upper portion thereof, and having an unfiltered-fuel chamber and a filtered fuel chamber;

a fuel supply pipe connecting said fuel cock with the bottom of said fuel reservoir;

an escape line connecting said drain cock with said fuel reservoir; and a downwardly inclined conduit leading from said strainer to said fuel pump means;

said drain cock being constructed and arranged to be switchable to any one of three positions, including a first position wherein said unfiltered-fuel chamber is connected with said escape line, a second position wherein said filtered-fuel chamber is connected with said escape line, and a third position wherein neither of said chambers is connected with said escape line.

2. A system for draining air and entrained vapor as recited in claim 1, wherein said escape line is inserted at an inclined angle into said fuel reservoir, and opens under the surface of liquid contained therein.

3. A system as recited in claim 1, wherein said drain cock is provided with spring means for automatically urging it to move into said third position.

4. A system as recited in claim 1, wherein the escape line opens into the fuel reservoir above the surface of liquid contained therein.

5. A system as recited in claim 4, wherein said escape line is inserted at an inclined angle into said fuel reservoir.

6. A system for draining air and entrained vapor contained within a fuel strainer and connected fuel paths of an engine, said system including;

an engine;

a fuel reservoir located on the engine at a relatively high position;

fuel pump means located on the engine at a relatively low position;

a fuel strainer located on the engine between said fuel reservior and said fuel pump means, said strainer including a fuel cock and a drain cock in the upper portion thereof, and having an unfiltered-fuel chamber and a filtered-fuel chamber;

a fuel supply pipe connecting said fuel cock with the bottom of said fuel reservoir;

an escape line connecting said drain cock with said fuel reservoir, said escape line opening into the fuel reservoir above the surface of liquid contained therein and having at least a portion thereof lying at an inclined angle;

a downwardly inclined conduit leading from said strainer to said fuel pump means;

said drain cock being constructed and arranged to be switchable to any one of three positions, including a first position wherein said unfiltered-fuel chamber is connected with said escape line, a second position wherein said filtered-fuel chamber is connected with said escape line and a third position wherein neither of said chambers is connected with said escape line; and means connecting said drain cock with the bottom of the fuel reservoir through a fuel flow pipe in addition to its connection with the space over the liquid surface within the fuel reservoir through said escape line, said escape line also including a transparent portion whereby it serves as a level gauge for the reservoir when the drain cock is switched to its third position.

7. A system as recited in claim 6, including additionally a scale adjacent said transparent portion of said escape line, for reading the liquid level in the reservoir.

8. A system as recited in claim 6, wherein said fuel reservoir has a depression formed therein along its height, for receiving said escape line.

* * * * *